United States Patent [19]

Pascetta

[11] 4,041,825

[45] Aug. 16, 1977

[54] KEYBOARD ASSIGNMENT SYSTEM FOR A POLYPHONIC ELECTRONIC MUSICAL INSTRUMENT

[76] Inventor: Armand N. Pascetta, 520 Revere Drive, Turnersville, N.J. 08012

[21] Appl. No.: 623,659

[22] Filed: Oct. 20, 1975

Related U.S. Application Data

[63] Continuation-in-part of Ser. No. 515,057, Oct. 15, 1974, abandoned, which is a continuation of Ser. No. 393,429, Aug. 31, 1973, abandoned.

[51] Int. Cl.[2] ..... G10H 1/00

[52] U.S. Cl. ..... 84/1.01; 84/1.03; 84/1.17; 84/1.19

[58] Field of Search ..... 84/1.01, 1.03, 1.17, 84/1.19

[56] References Cited

U.S. PATENT DOCUMENTS

| | | | |
|---|---|---|---|
| 2,997,908 | 8/1961 | Hilborn | 84/1.19 X |
| 3,515,792 | 6/1970 | Deutsch | 84/1.03 |
| 3,604,299 | 9/1971 | Englund | 84/1.03 |
| 3,610,799 | 10/1971 | Watson | 84/1.01 |
| 3,697,661 | 10/1972 | Deutsch | 84/1.01 |
| 3,715,444 | 2/1973 | Pearlman | 84/1.01 |
| 3,743,755 | 7/1973 | Watson | 84/1.03 |

*Primary Examiner*—Ulysses Weldon
*Attorney, Agent, or Firm*—Allan M. Shapiro

[57] ABSTRACT

A keyboard assignment system for a polyphonic electronic musical instrument employs a small number (typically ten or twelve) of output channels each capable of storing a note identification code used to control generation of a corresponding tone. Output channels are assigned and/or released during an assignment cycle initiated when any keyboard key is depressed or released. During the assignment cycle a keyboard switch matrix and an encoding matrix cooperate to provide sequentially on a data buss note identification codes corresponding to depressed keys. The data buss is connected to all output channels. An identity signal is produced by each output channel which is storing a note identification code corresponding to any which appears on the data buss during the assignment cycle. Assignment logic, responsive to these identity signals, assigns an output channel to each newly depressed key on a priority basis, and releases each output channel which had been assigned to a key which is now released.

11 Claims, 5 Drawing Figures

KEYBOARD ASSIGNMENT SYSTEM FOR A POLYPHONIC ELECTRONIC MUSICAL INSTRUMENT

BACKGROUND OF THE INVENTION

1. Related Applications

The present application is a continuation-in-part of the copending application Ser. No. 515,057 filed Oct. 15, 1974 abandoned which itself is a continuation of application Ser. No. 393,429 filed Aug. 31, 1973, now abandoned.

2. Field of the Invention

The present invention relates to a keyboard assignment system in a polyphonic electronic musical instrument.

3. Description of the Prior Art

A typical keyboard electronic musical instrument such as an electronic organ includes a large number of manual and pedal keys used for note selection. For example, even a small home electronic organ may have two manuals, each covering five octaves, and a pedal keyboard of another octave, for a total of 132 keys. As each key is depressed, a corresponding musical tone is produced by the instrument. A separate tone generator could be provided for each manual and pedal key. However, this would result in a costly, complex instrument.

A more practical approach recognizes that at any one time only a small number of keys, generally twelve or less, will be selected. (The playing of twelve notes simultaneously requires all ten fingers and both feet.) Accordingly, an instrument need only be capable of generating twelve tones at a time. This may be implemented by providing twelve oscillators or other tone generators of controllable frequency. The problem then is to connect the proper frequency determining element or control voltage to a particular tone generator as each note selection key is depressed. In other words, each depressed key must be assigned to an oscillator and interconnected so as to cause that oscillator to produce the desired note. A principal object of the present invention is to provide such a keyboard assignment system for an electronic musical instrument.

Some polyphonic keyboard switching systems having oscillator priority assignments are shown in the U.S. Pat. No. 2,997,908 to Hilborn and No. 3,715,144 to Pearlman. In those systems, the switching matrix incorporates a plurality of linear switch arrays each responsive to the operation of a corresponding key. In the Hilborn system, actuation of any key connects a frequency determining tuned circuit associated with that key via the switching matrix to one of a small plurality of oscillators. In the Pearlman system, actuation of the key connects a certain note-defining control voltage to one of say twelve voltage controlled oscillators. In both systems, the switch matrix assigns keys to the oscillators on a priority basis. Thus, e.g., the key associated with the highest selected note is assigned to the first oscillator; the next actuated key, which need not be the next adjacent key, is assigned to the second oscillator; and so forth.

A shortcoming of systems of the type described is that each oscillator is not latched or permanently assigned to the selected key for the duration, in which that key is depressed. In other words, if several keys are depressed, each will be assigned to a respective oscillator. However, if one of those keys is released while the others remain depressed, different oscillators may be reassigned to the keys remaining depressed at the time the first is released. As a result, an unpleasant clicking or discontinuity occurs in the generated tone as the oscillators are switched upon release of one key. Moreover, the newly assigned oscillator, although receiving the same control voltage or connected to the same frequency determining circuit, may produce a sound slightly detuned from that generated by the oscillator previously assigned to the same key. Clearly this will result in an unpleasant musical sound, which requires very careful matching of the oscillator parameters to eliminate.

Another object of the present invention is to provide a polyphonic keyboard assignment system wherein this problem is eliminated by assigning each selected key to a tone generator which remains latched to that key for as long as the key is depressed. Discontinuity problems resultant from reassignment of oscillators during continued note production is eliminated.

SUMMARY OF THE INVENTION

These and other objectives are achieved by providing a keyboard assignment system, operative in a polyphonic musical instrument, and having a small plurality N (typically ten or twelve) of output channels each with an associated tone generator. Whenever a key is depressed or released, an assignment cycle is initiated, during which an output channel is assigned to each newly depressed key or unlatched from each newly released key. Once assigned, an output channel remains latched to the same key, without interruption, until that key finally is released.

The output channel assignment cycle is controlled by a main sequencer, typically an eight stage recirculating shift register or counter of modulo 8. The main sequence repetitively and sequentially produces control pulses on eight lines to control operation keyboard scanning and priority assignment logic which enables the output channels. Each assignment cycle is defined by N+2 successive cycles of the main sequencer.

A matrix of switch arrays associated with individual keys is used to interconnect N matrix input lines to an encoding matrix. The matrix input lines are energized sequentially during successive main sequencer cycles. If an energized input line is connected by a key actuated switch array to the encoding matrix, a note identification code associated with that key is provided on a data buss. If no output channel already has been assigned to that key, the assignment logic will enable entry and storage of that note-identification code into the next available output channel. Thereafter, a gate enable signal will latch that output channel to the corresponding key.

On succeeding output channel assignment cycles, so long as that key remains depressed, an identity signal will be produced by the assigned output channel whenever that depressed key is scanned. The identity signal will set one of N latches in a register to designate prior assignment of the output channel. The setting of these N latches, in conjunction with certain priority logic, establishes which available output channel is next to be assigned. The same N latches effectively maintain the output channels assigned to depressed keys, when other output channels are unlatched from newly released keys during the final main sequencer cycle of each assignment cycle.

DESCRIPTION OF THE PREFERRED EMBODIMENT

Figure 1:
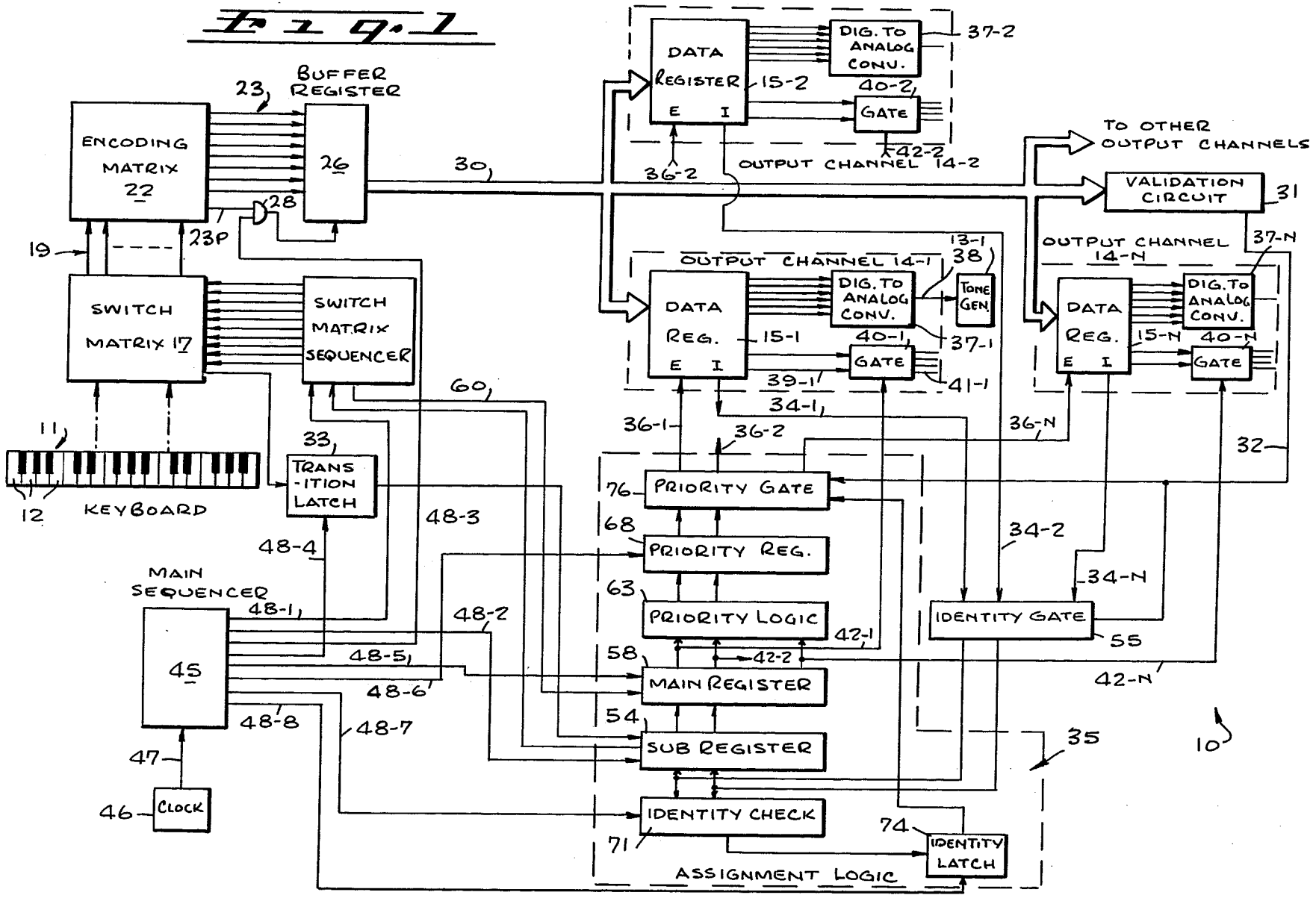
FIG. 1 is an electical block diagram of a keyboard assignment system in accordance with the present invention.

The inventive keyboard assignment system 10 (FIG. 1) advantageously is employed in a polyphonic electronic musical instrument having one or more keyboards 11 each having multiple note selection keys 12. Tone generation is accomplished by small number N (typically twelve) of tone generators 13 each associated with a respective output channel 14. The system 10 functions to assign, on a priority basis, an available output channel 14 and tone generator 13 to each selected key 12. A digital code identifying the selected note is stored in a data register 15 of the assigned output channel which causes the associated tone generator 13 to produce the desired musical tone. The same output channel 14 and tone generator 13 remains latched to one key 12 for the entire duration of time that the key 12 is depressed.

To accomplish the foregoing functions, each key 12 is mechanically linked to an individual linear switch array 16 (FIG. 2) contained in a matrix 17. The switch matrix 17 has a number N of input lines 18 equal to the number of output channels 14 in the system 10. Leading from the matrix 17 is a plurality of lines 19 each associated with a corresponding key 12 on the keyboard 11.

Figure 2:
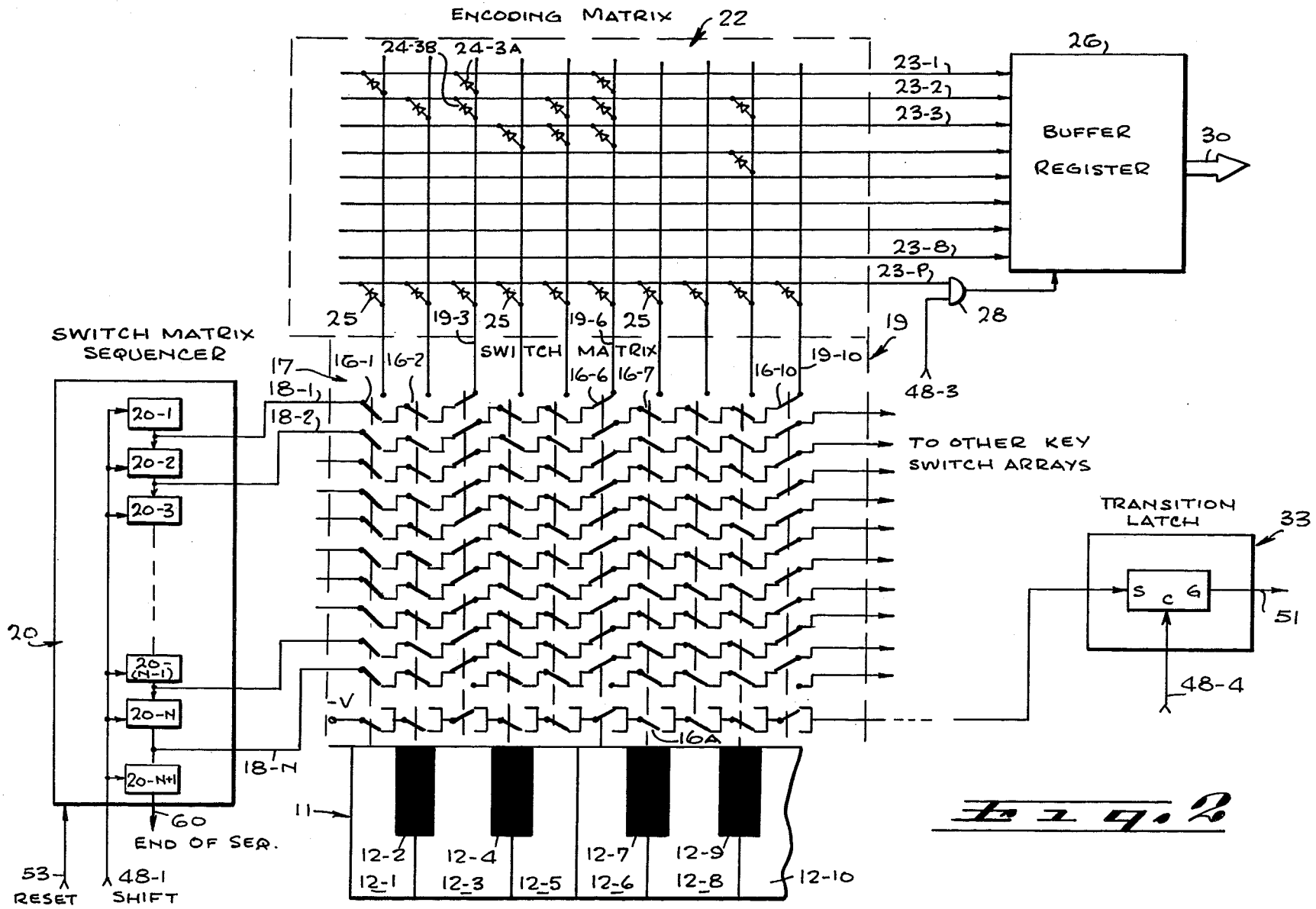
FIG. 2 is a simplified electrical schematic diagram of the switch matrix, switch matrix sequencer and encoding matrix components of the inventive system.

The switch matrix 17 selectively interconnects the input lines 18 to seleced output lines 19 on a priority basis. This is illustrated in FIG. 2 where the keys 12-3, 12-6 and 12-10 all have been depressed to close the associated switch arrays 16-3, 16-6 and 16-10. As a result, the input line 18-1 is connected to the output line 19-3 associated with the lower-most selected key 12-3. The second and third input lines 18-2, 18-3 respectively are connected to the output lines 19-6, 19-10 associated with the second and third lowest selected keys 12-6 and 12-10.

The switch matrix input lines 18 are energized sequentially by a switch matrix sequencer 20, which may comprise a shift register having N stages 20-1 through 20-N. As each input line 18 is energized, a signal appears on the output line 19 then connected via the matrix 17 to that input line 18. This in turn causes an encoding matrix 22 to produce on a set of parallel lines 23 a binary code uniquely identifying the selected key 12 which has caused interconnection of the energized line 18 to the encoding matrix 22.

This encoding operation is understood by reference to FIG. 2. A signal applied to the line 18-1 is transferred to the switch matrix output line 19-3 associated with the selected key 12-3. This line 19-3 is connected by diodes 24-3A, 24-3B to the encoding matrix output lines 23-1 and 23-2 so that a high signal (binary 1) appears on these lines. The remaining output lines 23-3 through 23-8 remain low (binary 0). The resultant binary code (11000000) supplied to a buffer register 26 uniquely identifies the selected key 12-3.

All of the lines 19 are connected by diodes 25 to a line 23P. As a result, a signal will occur on the line 23P whenever any input line 18 is energized and at least one key 12 is selected. Occurrence of a signal on the line 23P thus indicates the presence of a note-identification code from the encoding matrix 22.

Data entry to the buffer register 26 is enabled by the coincident occurrence of a gating signal on a line 48-3 and the "code present" signal on the line 23P. These two signals are combined by an AND gate 28 to provide an enable signal for the buffer register 26. The entered note-identification code remains stored in the buffer register 26 after termination of the enable signal, until a new code subsequently is entered. The code stored in the buffer register 26 is supplied to all of the output channels 14 via a parallel data buss 30. The presence of a valid key-identification code on the buss 30 is detected by a validation circuit 31. If a code is present, the circuit 31 will provice a high signal on a line 32. If no code is present in the data buss 30, the line 32 will remain low.

Figure 3:
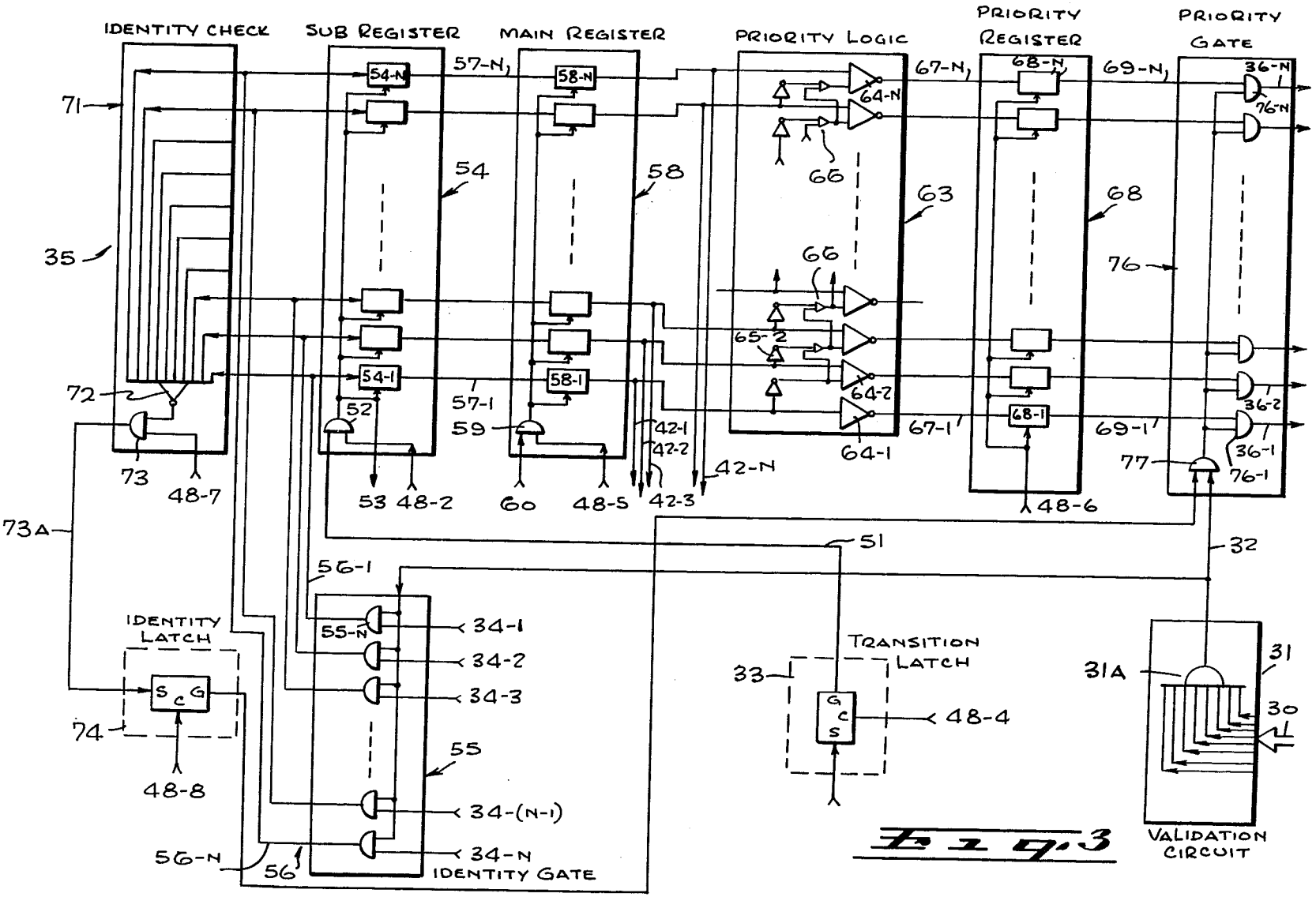
FIG. 3 is an electrical block diagram of the output channel assignment logic employed in the system of FIG. 1.

Depression or release of any key 12 causes the setting of a transition latch 33. This is accomplished by a set of series connected single pole-double throw switch segments 16A each contained in a switch array 16. Either a negative (−V) or positive voltage source is connected via this series of switch segments 16A and a line 33A to the set (S) input of the transition latch 33 (FIGS. 2 and 3). When any key 12 is depressed or released, the corresponding switch segment 16A will be thrown from one position to the other. This momentarily interrupts current flow from the voltage source, and produces a transient on the line 33A, which transient sets the latch 33. A high output then is provided from the output (Q) of the latch 33 indicating that a keyboaard transition has occurred. This latch output signal remains high until a reset signal is supplied to the clear (c) terminal of the latch 33.

Each time a new note-identification code appears on the data buss 30, it is compared with the code previously stored in the data register 15 of each output channel 14. If an output channel 14 already has been assigned to the depressed key 12 identified by the code on the buss 30, the corresponding data register 15 provides an "identity" signal on a line 34 from the assigned output channel 14. For example, the output channel 14-1 may already have been assigned to the depressed key 12-3. In this instance, when the code (11000000) identifying that key occurs on the buss 30, the data register 15-1 in the output channel 14-1 will provide an "identity" signal on the line 34-1. Since no other output channel will be assigned to the same key, the identity (I) outputs of all other data registers 15-2 through 15-N will be zero. These "identity" signals serve two functions. First, they indicate that the depressed key 12 presently being scanned already has been assigned to an output channel 14. Secondly, they are utilized by the output channel assignment logic 35 to identify which output channels 14 remain available for subsequent assignment.

If the depressed key 12 identified by the code appearing on the buss 30 has not been assigned an output channel 14, none of the identity lines 34 will contain an "identity" signal. This will be the situation the first time that a newly depressed key is scanned, and will cause the assignment logic 35 to enable the next available output channel 14 to receive the new note-identification code. To this end, the assignment logic 35 will provide an enable signal on one of N output channel enable lines 36. This signal will enable the data register 15 in the assigned output channel 14 to accept and store the note-identification code from the buss 30. For example, an enable signal on the line 36N will cause the code present on the buss 30 to be entered in the data register 15-N, thereby assigning the output channel 14-N to the newly depressed key identified by that code.

A note-identification code stored in a data register 15 will remain therein at least so long as the corresponding key 12 remains depressed. During this period of time, the stored code is available for control of the associated tone generator 13. By way of example, the tone generator 13 may comprise a voltage controlled oscillator. In such case, certain of the note-identification code bits are sent to a digital-to-analog converter 37 which provides a control voltage specified by these bits. This control voltage, supplied to the oscillator 13 via a line 38, causes generation of the requisite note.

Certain of the note-identification code bits may indicate the particular keyboard 11 containing the depressed key 12 assigned to that output channel 14. These code bits, supplied from the data register 15 via certain lines 39 and a gate 40 may be used to enable the tone generator 13, or one of a small plurality of like tone generators all controlled by the signal on the line 38, or to enable various wave-shaping or timbre-determining circuits (not shown) associated with different keyboard stops. The gate 40 may include conventional decoding logic so that an enabled output appears e.g., on one of four output lines 41 each used to enable to respective one of four different tone generation circuits. The gate 40 in each output channel 14 is enabled by a signal supplied via a respective line 42 from the output channel assignment logic 35. When a key 12 is released, the enable signal on the line 42 to the assigned output channel 14 terminates, thereby unlatching that output channel.

Scanning of the switch matrix 17 and priority assignment of the output channels 14 both are controlled by a main sequencer 45 incremented at a rate established by a clock 46. The main sequencer 45 may comprise an eight-stage recirculating shift register containing a single binary one bit which is shifted from stage to stage in response to occurrence of shift pulses supplied via a line 47 from the clock 46. The sequencer 45 continuously provides sequential control pulses on the output lines 48-1 through 48-8. These main sequencer 45 pulses control operation of the switch matrix sequencer 20 so as to scan the switch matrix 17, control operation of the assignment logic 35 so as to assign output channels 14 to newly depressed keys 12 in a priority manner, and control unlatching of the associated output channel 14 when a key 12 is released.

Switch matrix scanning and output channel assignment or release is accomplished during an assignment cycle which is initiated by setting of the transition latch 33. Each assignment cycle encompasses N+2 complete cycles of the main sequencer 45. During the first-cycle, certain assignment logic 35 circuits are cleared and the transition latch 33 is cleared.

On each of the next N complete main sequencer 45 cycles, a successive one of the switch matrix input lines 18 is energized. If that energized line 18 is connected to the encoding matrix 22 by a switch array 16 actuated by a newly depressed key 12, an output channel 14 is assigned to that key. If an output channel 14 already has been assigned to the key 12 associated with the energized line 18, that output channel 14 will remain latched to the same key. If a key 12 has been released, the gate enabling signal on the line 42 to the output channel 14 previously assigned to that key will terminate, thereby "unlatching" the output channel.

OPERATION OF THE OUTPUT CHANNEL ASSIGNMENT LOGIC 35

A. Assignment of an Output Channel 14 to the First Depressed Key 12

With no keys 12 depressed, all of the output channels 14 are available for assignment. If one key 12, say the key 12-3 is pressed, the highest priority output channel 14-1 will be assigned to this key by the assignment logic 35 through the following operation.

At the instant that the key 12-3 is depressed, the transition latch 33 is set, producing a high "transition has occurred" signal on line 51. This will initiate a new assignment cycle. During the first main sequencer 45 cycle the switch matrix sequencer 20 will be reset. This will ensure scanning of the switch matrix 17 beginning from the line 18-1 during successive main sequencer 45 cycles.

At the second step of the first main sequencer 45 cycle, the pulse on the line 48-2 is supplied to an AND gate 52 (FIG. 3) which is enabled by the "transition has occurred" signal on the line 51. Thus, the AND gate 52 provides an output on a line 53 to the "reset" input of the switch matrix sequencer 20, causing that sequencer 20 to reset. The signal on the line 53 also clears a sub-register 54 consisting of N latches 54-1 through 54-N. At step four of the main sequencer 45 cycle, the transition latch 33 is cleared by the pulse on the line 48-4.

Upon occurrence of the next shift pulse 48-1 at the beginning of the second main sequencer 45 cycle, the switch matrix input line 18-1 energized. Since only the key 12-3 is depressed, the line 18-1 is connected via the switch array 16-3 (FIG. 2) to the line 19-3. Thus, since the line 18-1 is energized, the encoding matrix 22 will provide on the output lines 23 a binary code uniquely indicative of the drepressed key 12-3. Occurrence of the third main sequencer 45 pulse on the line 48-3 enables the buffer register 26 to store this note-identification code and to provide this code on the buss 30.

No output channel 14 has yet been assigned, thus no data register 15 will contain the key 12-3 note-identification code now present on the buss 30. Thus no "identity" signal will be supplied to any of the lines 34. However, the validation circuit 31 will produce a high "code present" signal on the line 32, indicating that a valid code is present on the buss 30. The validation circuit 31 (FIG. 3) consists of an OR-gate 31A receiving as inputs all of the lines of the data buss 30.

The "code present" signal on the line 32 enables an identity gate 55 consisting of N individual AND gates 55-1 through 55-N each associated with a respective identity line 34. Since no "identity" signal is present, all of the output lines 56 from the identity gate 55 will be low. Thus, none of the latches 54-1 through 54-N in the sub-register 54 will be set. All of the output lines 57 from the sub-register 54 will be low so that none of the latches 58-1 through 58-N in a main register will be set.

At the fourth and fifth steps of the second main sequencer 45 the respective output signals on the lines 48-4 and 48-5 cause no action. The pulse on the line 48-4 has no effect since the transition latch 33 already has been cleared. The fifth pulse of the main sequencer 45 cycle, on the line 48-5, is supplied to an AND gate 59 which is used to reset the main register 58 during the last main sequencer 45 cycle. Now however, no "end of sequence" signal is present on a line 60 from the sequencer 20, so that the AND gate 59 is disabled. The main register remains unchanged, with none of the latches 58-1 through 58-N being set. Accordingly, all of the output channel enable lines 42 leading from the latches 58-1 through 58-N of the main register 58 are low. None of the output channel gates 40 is enabled.

Certain priority logic 63 establishes which output channel 14 next is to be assigned. The priority logic 63 includes a set of NOR gates 64 each receiving as one input the signal on a corresponding output channel enable line 42. The NOR gates 64 are interconnected by a set of NOR gates 65 and set of OR gates 66 in such a manner that an output will occur from one and only one of the NOR gates 64. If all of the lines 42 are low, the NOR gate 64-1 associated with the low order line 42-1 will provide a high output on a line 67-1. If any of the lines 42 is high, an output will be produced from that NOR gate 64 of next higher order than the highest order line 42 containing an output channel enabling signal. For example, if the lines 42-2 and 42-5 both were high, only the NOR gate 64-6 would provide a high output. In that instance, all of the lines 67 would be low, except for the line 67-6 from the NOR gate 64-6. As will be seen, the one high signal on the lines 67 identifies the next output channel 14 to be assigned.

In the situation where no output channel 14 is assigned, so that all of the lines 42 are low, a high signal is obtained only on the line 67-1 from the priority logic 63. This indicates that the output channel 14-1 is next to be assigned. On occurrence of the sixth pulse of the main sequencer 45 cycle on the line 48-6, a priority register 68, consisting of the latches 68-1 through 68-N, is cleared. However, since the single line 67-1 high, the latch 68-1 then will not be cleared, but will produced a high output on the line 9-1. All of the other lines 69 from the priority register 63 will be low.

At the seventh step of the main sequencer 45 cycle, a check is made to determine whether the code present on the buss 30 already has been stored in any data register 15. This is carried out by an identity check circuit 71 enabled by the pulse on the line 48-7. The check circuit 71 consists of an N input NOR gate 72 receiving all the identity gate ouput lines 56 as inputs. If no data register 15 is storing the code on the buss 30, all of the "identity" signals on the lines 34 and on the lines 56 will be low; so that the NOR gate 72 will have a high output. This high output, supplied via and AND gate 73 enabled by the pulse on the line 48-7 and via a line 73A, sets an identity latch 74. This produces a "note not assigned" signal on the latch output line 75 indicating that the code on the buss 30 has not been stored in any data register. (Conversely, if an output channel 14 already has been assigned to the key 12 associated with the code present on the buss 30, one of the data register 15 will put out an "identity" signal so that one of the lines 56 will be high. In this instance, the output from the indentity check circuit 71 will be low, and the identity latch 74 will not be set. The low signal on the line 75 thus indicates that an output channel 14 already has been assigned.)

Concurrence of the "note not assigned" signal on the line 75 and a "code present" signal on the line 32 causes a priority gate 76 to enable entry of the note-identification code from the buss 30 into the output channel 14 next to be assigned. To this end, an AND gate 77 receiving the signals on the lines 32 and 75 enables as set of AND gates 76-1 through 76-N connected to the lines 69. The outputs of the gates 76-1 through 76-N are connected to the data register enable lines 36-1 through 36-N. Since only one of the lines 69 is high, when the priority gate 76 is enabled, a high output occurs only on the single line 36 to the output channel 14 specified by the priority logic 63 as being the next to be assigned.

Where no output channel 14 already is assigned, an output will occur on the line 36-1 to the output channel 14-1. The signal on the line 36-1 will cause the note-identification code present on the buss 30 to be stored in the data register 15-1. As soon as the code is entered, an "identity" signal appears on the line 34-1. This is transferred via the identity gate 55 to the line 56-1, so as to set the latches 54-1 and 58-1. The resultant high signal on the line 42-1 enables the gate 40-1, thereby assigning the output channel 14-1 to the key 12-3. The identity latch 74 is cleared by the eighth pulse of the main sequencer 45 cycle, on the line 48-8, thereby completing assignment of the output channel 14-1 to the first depressed key 12-3.

During each of the next (N-1) cycles of the main sequencer, the switch matrix input lines 18-2 through 18-N will be energized. However, since only the one key 12-3 is depressed, no note identification code will be provided to the buss 30 during these cycles. The validation circuit 31 will not produce a "code present" signal, so that the priority gate 76 will remain disabled. No other data register 15 enabling signals will be produced, so that all other output channels 14-2 through 14-N will remain unassigned.

During the final main sequencer 45 cycle, the switch matrix sequencer 20 will provide an end-of-sequence signal on the line 60. Accordingly, when a pulse occurs on the line 48-5, all of the main register 58 latches will be cleared except those receiving a high input from the corresponding sub-register latch 54. In this example, where only one key 12-3 is depressed, the latch 54-1 has been set so that the latch 58-1 will remain set even though a clear signal is received from the AND gate 59. Thus the line 42-1 remains high and the gate 40-1 remains enabled. That is, the output channel 14-1 remains latched to the key 12-3.

B. Output Channel Assignment With Another Output Channel Previously Assigned

The foregoing section describes assignment of an output channel 14 to the first key (e.g., the key 12-3) to be depressed. If another key, say the key 12-6, now is selected while the first key 12-3 remains depressed, the next available priority channel 14-2 will be assigned to the newly depressed key 12-6 in the following way.

When the key 12-6 is despressed, the transition latch 33 is set, initiating a new assignment cycle. Therefore, at the second step of the second main sequencer 45 cycle, the switch matrix sequencer 20 is reset to energize the line 18-1. As shown in FIG. 2, this line 18-1 is connected to the encoding matrix 22 via the switch 16-3 actuated by the key 12-3. As a result, the code appearing on the buss 30 is that identifying the key 12-3 to which the output channel 14-1 already is assigned. Since the data register 15-1 contains the same code now present on the buss 30, a high "identity" signal occurs on the line 34-1. This identity signal is transferred via the identity gate 55 to the sub-register 54 which was cleared at the beginning of the new assignment cycle. The transferred identity signal sets the sub-register latch 54-1; the main register latch 58-1 remains in the set condition. The output channel enable line 42-1 stays high, so that the output channel 14-1 remains latched to the key 12-3.

As a result of the high signal on the line 42-1, an output will occur on the line 67-2 from the priority logic 63, designating the output channel 14-2 as the next to be assigned. The latch 68-2 in the priority register 68 will be set. The latch 68-2 will remain set even upon occurrence of the pulse on the line 48-6 from the main sequencer 45 which clears the latch 68-1 that had been set previously.

At the seventh step of the second main sequencer 45 cycle, the pulse on the line 48-7 will enable the identity check circuit 71. Since a high "identity" signal is present on the line 56-1, the identity check circuit 71 will produce a low output on the line 73A indicating that the code on the buss 30 already has been stored (in the assigned output channel 14-1). As a result, the identity latch 74 will not be set and the line 75 will remain low. Thus the priority gate 76 will not be enabled and no data register enable signal will be provided on any of the lines 36. Occurrence of the eighth main sequencer 45 pulse, on the line 48-8, will have no effect on the identity latch 74, since that latch was not set. This completes a cycle of the main sequencer 45.

Upon occurrence of the next clock 46 pulse, the main sequencer 45 automatically will reset to begin the third cycle. The next pulse on the line 48-1 will shift the switch matrix sequencer 20 so as to energize the switch matrix input line 18-2. This line 18-2 is connected via the switch array 16-6 actuated by the key 12-6 to the matrix output line 19-6. Accordingly, the encoding matrix 22 will produce a code indicative of the newly selected key 12-6. The switch matrix sequencer 20 will not be reset upon occurrence of a pulse on the line 48-2, since the transition latch 33 previously was reset. Thus the line 51 is low and the AND gate 52 is disabled.

At the third step of the third main sequencer 45 cycle, the pulse on the line 48-3 will cause the new note-identification code to be entered into the buffer register 26 and to appear on the buss 30. Since this new code is not stored in any data register 15, no "identity" signal will appear on any of the lines 34. As a result, no additional sub-register 54 or main register 58 latch will be set. However, the latches 54-1 and 58-1 which were set from the previous main sequencer cycle, remain set. Thus, the priority logic 63 continues to produce an output channel assignment signal on the line 67-2. The latch 68-2 in the priority register 68 remains set even after occurrence of the main sequencer pulse 48-6.

At the seventh step of the main sequencer 45 cycle, the identity check circuit 71 again is enabled. Now, a high output occurs on the line 73A and the identity latch 74 is set. The resultant "note not assigned" signal on the line 75, together with the "code present" signal on the line 32, enables the priority gate 76. Since the AND gate 76-2 is receiving the output channel assignment signal, a high output occurs on the data register enable line 36-2. This causes the code on the buss 30 to be entered into the data register 15-2 associated with the output channel 14-2. As soon as the code is entered, an "identity" signal appears on the line 34-2. This is transferred via the identity gate 55 to the line 56-2 so as to set latches 54-2 and 58-2. The resultant signal on the line 42-2 enables the gate 40-2. In this manner, the next highest priority output channel 14-2 is assigned to the newly selected switch 12-6.

Since no other keys 12 are depressed, no additional output channels 14 are assigned during the remaining main sequencer 45 cycles. During the final $(N+2)^{th}$ main sequencer cycle, the AND gate 59 is enabled to clear the main register 58. However, since both latches 54-1 and 54-2 are set, the latches 58-1 and 58-2 remain set so that the output channels 14-1 and 14-2 remain latched to the respective keys 12-3 and 12-6.

C. Unlatching of an Output Channel Upon Release of a Key

To describe the unlatching operation, assume initially that the keys 12-3 and 12-6 have been depressed and assigned respectively to the output channels 14-1 and 14-2. Now suppose the key 12-3 is released, while the key 12-6 remains selected. The transition latch 33 will be set, providing a high signal on the line 52. As a result, a new assignment cycle will begin. During the first main sequencer 45 cycle, the sub-register 54 will be cleared and the switch matrix sequencer 20 will be reset. The main register latches 58-1 and 58-2 remain set, so that the gate enable lines 42-1 and 42-2 stay high.

During the second main sequencer cycle, the line 18-1 is energized. Now the line 18-1 is connected via the switch array 16-6 to the line 19-6, so that the encoding matrix 22 provides a code identifying the key 12-6. Upon occurrence of the pulse on the line 48-3, this code is provided on the buss 30. Since the output channel 14-2 was assigned to the key 12-6, the data register 15-2 will provide an "identity" signal on the line 34-2. This signal, gated via the identity gate 55 and the line 56-2, will set the sub-register latch 54-2 and main register latch 58-2. The gate enable signal on the line 42-2 remains high, maintaining the output channel 14-2 enabled and hence latched to the key 12-3.

On each successive main sequencer 45 cycle, there will be no note-identification code provided on the buss 30, since no other keys are depressed. Therefore no other data registers 15 will provide "identity" signals, and no other sub-register latch 54-1 or 54-3 through 54-N will be set. Note specifically that the sub-register latch 54-1 is not set since the note-identification code associated with the key 12-3, now released, is not provided on the buss 30. Thus no "identity" code is produced by the output channel 14-1, even though the data register 15-1 still contains that note-identification code and, at this stage of the assignment cycle, the gate 40-1 is still enabled.

Finally, at step five of the last main sequencer 45 cycle, the pulse on the line 48-5 and the "end-of-sequence" signal on the line 60 enable the AND gate 59. This clears all of the main register latches 58 except any then receiving high inputs from the sub-register 54. Specifically, the latch 58-1 will be cleared, since the sub-register latch 54-1 no longer is set. Consequently, the gate enable signal on the line 42-1 will terminate, thereby unlatching the output channel 14-1, exactly as desired. The latch 58-2 will remain set since the latch 54-2 is set, hence the output channel 14-2 will remain latched to the key 12-6 which is still depressed.

Figure 4:
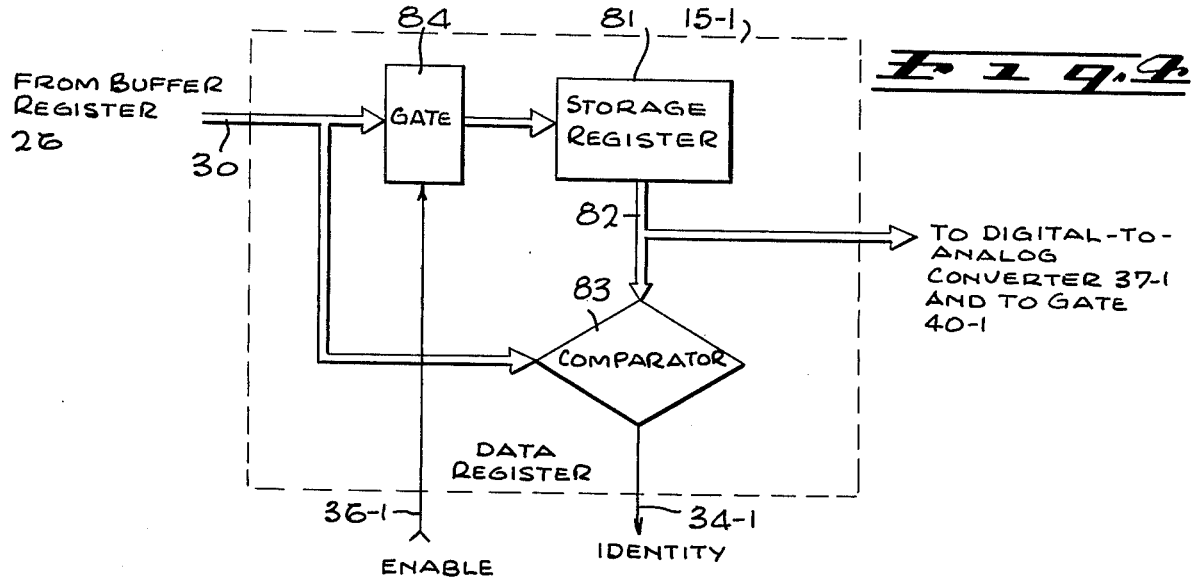
FIG. 4 is an electrical block diagram of a data register that may be employed in the keyboard assignment system of FIG. 1.
Figure 5:
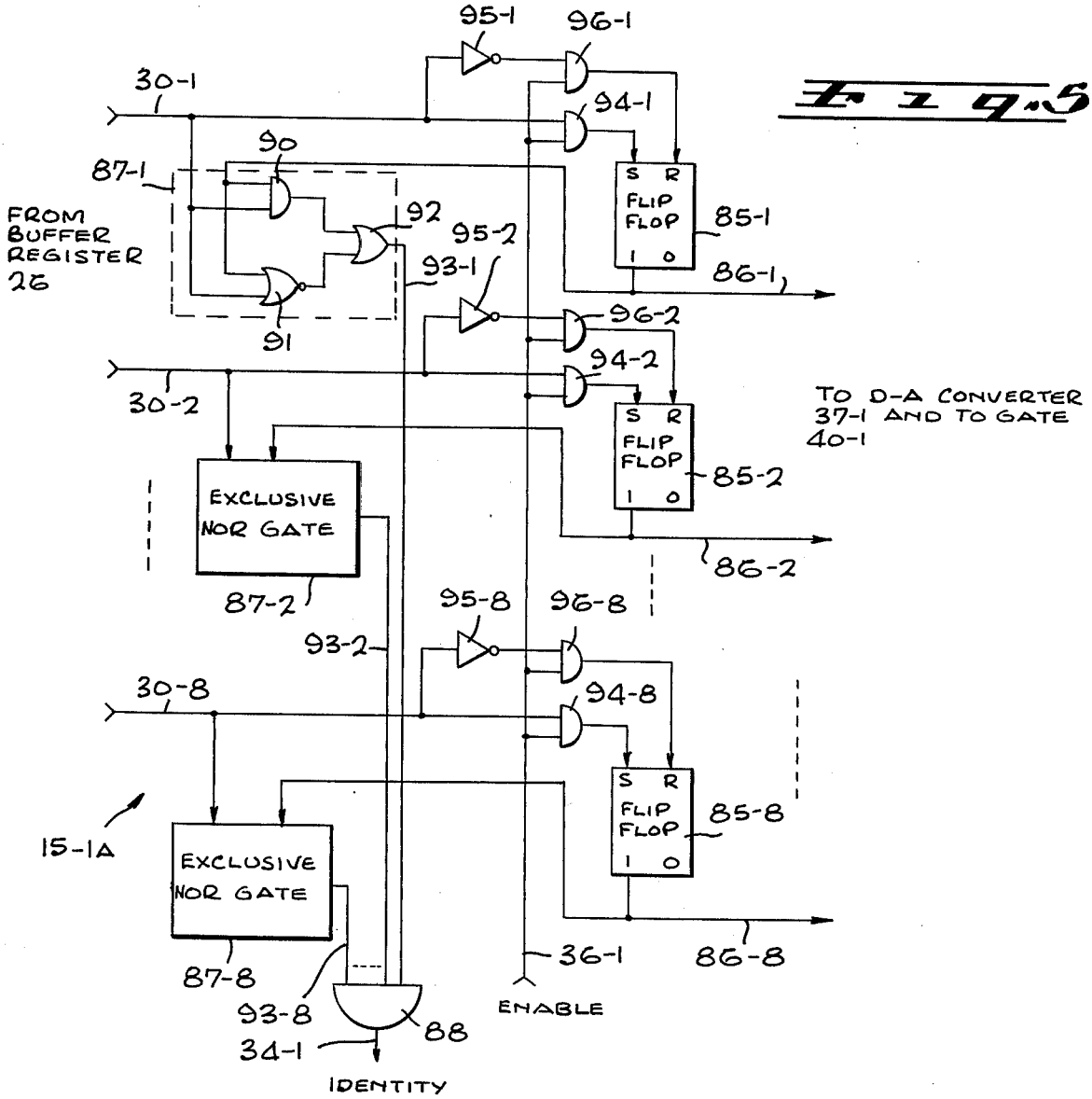
FIG. 5 is an electrical schematic diagram of another embodiment of a data register that may be used with the system of FIG. 1.

Illustrative circuitry for a typical data register 15-1 is shown in FIG. 4. Referring thereto, if a key has been assigned to the data register 15-1, the corresponding note-identification code will be stored in a storage register 81. The contents of the register 81 (i.e., the stored note-identification code) is supplied via a buss 82 (i.e. a set of parallel bit lines) to the digital-to-analog converter 37-1 and to the gate 40-1 and also to a comparator 83. The comparator 83 receives as its second input the note-identification code currently present on the buss 30. If the code present on the buss 30 is identical to the code stored in the register 81, a high output signal is provided by the comparator 83 on the line 34-1; this is the "identity" signal. If the codes are different, no "identity" output signal is produced by the comparator 83.

If the note-identification code currently present on the buss 30 is to be entered into the data register 15-1, the "enable" signal on the line 36-1 enables a gate 84. This passes the code from the buss 30 into the storage register 81 where it is stored in place of the previous contents thereof.

The storage register 81 and comparator 83 typically may be implemented using commercially available integrated circuits. For example, for an 8-bit note identification code, the storage register 81 may comprise a pair of Texas Instruments type SN54L98 or SN74L98 4-bit data selector/storage registers which themselves incorporate a data entry gate useful as the gate 84. The comparator may comprise two Texas Instruments type SN54L85 or SN74L85 4-bit magnitude comparators.

Alternative circuitry for each data register 15-1A includes a set of flip-flops 85-1 through 85-8 that store the note-identification code for the assigned key. The stored code is represented by the flip-flop 1 outputs present on the respective lines 86-1 through 86-8. The stored code is compared with the code present on the buss 30 (consisting of the eight bit lines 30-1 through 30-8) by a set of exclusive-NOR-gates 87-1 through 87-8 and an eight-input AND-gate 88, the output of which is the "identity" signal on the line 34-1.

Typical exclusive-NOR-gate 87-1 consists of an AND-gate 90, a NOR-gate 91 and an OR-gate 92 that cooperate to provide a high output on a line 93-1 only when the two input bits present respectively on the lines 30-1 and 86-1 are identical. All of the output lines 93-1 through 93-8 will be high only when all of the code bits present on the buss 30 are identical to the code stored in the flip-flops 85-1 through 85-8. Only then will the AND-gate 88 produce the "identity" output signal.

A new code is entered into the flip-flops 85-1 through 85-8 by occurrence of an "enable" on the line 36-1. This signal enables the AND-gates 94-1 through 94-8 to pass any binary 1 bits from the buss 30 to the set (S) input of the corresponding flip-flops 85-1 through 85-8 so as to produce a high 1 output therefrom. If any of the bits in the code on the buss 30 are 0, the respective inverters 95-1 through 95-8 provide high signals which are gated by the AND-gates 96-1 through 96-8 to reset the respective flip-flops 85-1 through 85-8 to zero. Thus the 1 outputs of these reset flip-flops are low, correctly representing the binary zeros in the now-stored notes-identification code.

I claim:

1. In a keyboard assignment system for an electronic polyphonic musical instrument having a keyboard containing keys, the improvement comprising:

a small plurality N of output channels each including a data register having a storage section for storing a note identification code utilizable to control tone generation, transition latch means, connected to said keyboard and actuated when any key is depressed or released, for providing a signal that initiates an output channel assignment cycle, a main sequencer which generates sets of sequential control pulses, there being at least N sets of control pulses generated during each assignment cycle, a parallel data buss connected to the data registers of all output channels, keyboard encoding means, connected to said keyboard, to said data buss and to said main sequencer and operative during said assignment cycle, for providing note identification codes associated with depressed keys to all of said output channels via said data buss, said codes being provided to said data buss sequentially during respective sequential generation by said main sequencer of said N sets of control pulses, the data register in each output channel also having identity means for producing an identity signal when that data register is storing a code corresponding to a code appearing on said data buss during said assignment cycle, and assignment logic means, connected to said main sequencer and to all said identity means and operative during said assignment cycle and in response to said sequential control pulses and to said identity signals, for enabling entry to an available output channel on a priority basis of each note identification code from said data buss not already stored in an output channel, thereby assigning an output channel to each newly depressed key and for releasing any previously assigned output channel which stores a code not provided on said data buss during the assigment cycle because the associated key has been released, said transition latch means being connected to provide said assignment cycle initiation signal to said keyboard encoding means and to said assignment logic means.

2. A keyboard assignment system according to claim 1 wherein said keyboard encoding means comprises:

an encoding matrix having an input line for each key of said instrument keyboard, and providing to said data buss a note identification code corresponding to an energized input line, a switch matrix of switch arrays each associated with a respective keyboard key, said matrix being operative to connect a like small plurality N of switch matrix input lines to those encoding matrix input lines corresponding to depressed keys, and switch matrix sequencer means for sequentially energizing said matrix input lines during each assignment cycle; so that said encoding matrix will sequentially provide to said data buss note identification codes determined by which encoding matrix input lines are connected by said switch matrix to the sequentially enabled switch matrix input lines, said transition latch means being connected so that said assignment cycle initiation signal resets said switch matrix sequencer means.

3. A keyboard assignment system according to claim 2 wherein said switch matrix sequencer means comprises a shift register which is reset at the beginning of each assignment cycle, said shift register being stepped sequentially by control signals from said main sequencer, the outputs from said shift register being used to energize said matrix input lines sequentially, said shift register providing an end of switch matrix sequence signal after the last switch matrix input line has been energized, said end sequence signal being utilized by said assignment logic means to terminate the assignment cycle.

4. A keyboard assignment system according to claim 1 wherein said assignment logic means comprises:

a sub-register having a like small plurality N of latches associated with respective output channels, said sub-register being connected to said transition latch, each of said N latches being operatively connected to a respective one of said identity means, all of said latches being cleared at the beginning of each assignment cycle upon occurrence of an assignment cycle initiation signal from said transition latch, said latches being individually set during said assignment assignment cycle in response to occurrence of identity signals from the corresponding output channel, priority logic, operatively connected to said sub-register, for designating the next available output channel for assignment, and a priority gate, operatively connected to said priority logic and actuated upon occurrence on said data buss of a note identification code not already stored in an output channel and hence indicative of a depressed key to which an output channel has not yet been assigned, for enabling entry of said not already stored note identification code from said data buss into the data register of the output channel designated by said priority logic, such enabled data entry causing production by said output channel of an identity signal which sets the corresponding latch in said sub-register.

5. A keyboard assignment according to claim 4 wherein said assignment logic means further comprises:

a main register connected to said sub-register and to said priority logic, including a like plurality N of latches each associated with a corresponding output channel and each set by a corresponding sub-register latch, clearing means, operatively connected to said keyboard encoding means and to said main register, for clearing all of said main register latches at the end of each assignment cycle except those associated with sub-register latches which have been set during that assignment cycle, a gate enable signal being provided to said associated output channel by each main register latch which is set, to enable utilization for tone generation of the note identification code stored in that corresponding output channel, said gate enable signal also being provided to said priority logic.

6. A keyboard assignment system according to claim 4 further comprising:

a validation circuit, connected to said data buss and to said priority gate, for providing to said priority gate a "code present" signal when any note identification code is present on said data buss, and identity latch means, operatively connected to all of said identity means and to said priority gate, for providing to said priority gate a signal indicating that, for the note identification code present on said data buss, no identity signal has been produced by any output channel, said signal thereby indicating that no output channel has been assigned to the key associated with that note identification code, and wherein said priority gate is enabled by the concurrence of said "code present" signal from said validation circuit and said indicating signal from said identity latch means.

7. A keyboard assignment system according to claim 1 wherein said data register comprises:

a storage register adapted to store a note-identification code, a comparator, connection to said storage register and to said data buss, for comparing the note-identification code stored in said storage register with each note-identification code present on said data buss and for providing said identity signal when the compared codes are identical, and gate means for gating the code present on said data buss into said storage register to replace the previous contents thereof, said gating means being enabled by said assignment logic means.

8. A keyboard assignment system according to claim 5 wherein said main sequencer generates N+2 sets of control pulses during each assignment cycle, where N equals the number of output channels in said system, said transition latch means being reset during generation of the first set, said switch matrix sequencer being stepped during generation of the next N sets, and said main register being cleared during generation of the last set.

9. In a keyboard assignment system comprising:

a matrix of switch arrays operated by respective keys of said keyboard, said matrix having sequentially energizable input lines connectable by said switch arrays in priority arrangement to key-selected ones of a plurality of individual-key-associated output lines, means for sequentially energizing said input lines, encoding means connected to said output lines for providing a parallel binary note identification code determined by the key-selected output line connected by said matrix to an energized matrix input line, said parallel binary codes thus being provided sequentially as said input lines are sequentially energized, a plurality of assignable output channels each containing a data register having a storage means connected, when enabled, to store the code provided by said encoding means and having comparator means connected to receive the note identification code from said encoding means and connected to said storage means, said comparator means providing an identity signal when the code presently supplied from said encoding means is identical to that code already stored in the date register storage means for that output channel, priority assignment means, operatively connected to said output channels and connected to receive the identity signals from each of the comparator means for providing a signal to an unassigned one of said output channels for enabling storage in said unassigned output channel of the note-identification code presently provided from said encoding means if no identity signal then is being produced by any of said output channels, initiation means, operatively connected to said keyboard for initiating operation of said priority assignment means for an assignment cycle started by the depression or release of any keyboard key, said matrix input lines being energized during sequential sub-cycles of said assignment cycle, and sequencing means, operatively connected to said priority assignment means and to said sequentially energizing means, for controlling operation of said priority assignment means and said matrix input line energization during said assignment cycle; and wherein said priority assignment logic includes register means, operatively connected to said comparator means and responsive to said identity signals, for providing an output channel gate enable signal to each output channel storing a note-identification code corresponding to one provided from said encoding means during the most recent assignment cycle, said gate enable signals enabling the stored note-identification codes to be utilized for generation of corresponding musical tones, the improvement wherein said register means comprises:

a sub-register having a plurality of latches corresponding to respective output channels, said latches all being cleared in response to a signal from said initiation means at the beginning of each assignment cycle, each latch being set by the occurrence of an identity signal from the corresponding output channel during said assignment cycle, and a main register connected to said sub-register and having a like plurality of latches each initially being set when the corresponding sub-register latch is set during the assignment cycle in which the corresponding output channel is assigned, all of said main register latches being cleared at the end of each assignment cycle except those associated with sub-register latches which were set during that assignment cycle, said gate enable signals being provided by the main latches which are set.

10. A keyboard assignment system according to claim 9 further comprising:

priority logic, connected to said main register and responsive to said gate enable signals, for designating the output channel next available for assignment, identity checking and latch means, operatively connected to all of said comparator means, for providing a "note not assigned" signal when no identity signal is received from any comparator means, and priority gate means, connected to said priority logic and enabled upon simultaneous occurrence of a note-identification code from said encoding means and a "note not assigned" signal indicating that said note-identification code is not already stored in one of said output channels, for enabling entry of that note-identification code into the next available channel designated by said priority logic.

11. A keyboard assignment system for use in an electronic musical instrument comprising:

a switch matrix actuated by said keyboard and including a plurality of switch arrays interconnected to connect one of a first set of input lines to an output line associated with each depressed switch in a priority order, a code matrix connected to said switch matrix to produce a parallel digital code indicative of the associated key when one of the switch matrix input lines is energized, a buffer register connected to said code matrix and enabled upon receipt of a data entry signal to provide said parallel digital code to a set of note-identification code lines, a switch matrix sequencer for sequentially energizing said switch matrix input lines, scanning control sequencer means for providing sets of sequential control signals, some of said control signals advancing said switch matrix sequencer means to energize the next switch matrix input line, another of said control signals comprising said data entry signal, a lesser plurality of output channels, each including a data register connect to said note-identification code lines to receive said note-identification codes therefrom, each data register having a data storage section and a comparator means, the comparator means in each data register being connected to said code lines and to the data storage section of the same data register for comparing the note-identification code present on said code lines with the contents of that data storage section and for providing an identity signal if said present code and said contents are identical, said identity signal indicating that the output channel providing the identity signal is assigned to the key associated with that note-identification code, priority logic means, operatively connected to said scanning control sequencer and responsive to said identity signals from all of said comparator means, for establishing, during a cycle of said scanning control sequencer, the next available unassigned output channel, validation circuit means, connected to said code lines, for providing a "valid code" signal when a note-identification code is present on said code lines, identity check means, operatively connected to all of said comparator means and responsive to said identity signals, for providing a "note not assigned" signal when no identity signal is provided from any of said comparator means, priority gate means, operatively connected to said validation circuit means, to said identity check means, and to said priority logic means, for assigning a newly selected note-identification code to said next available output channel, said gate means providing a data entry signal to said next available output channel in response to simultaneous occurrence of a "valid code" signal and a "note not assigned" signal, said data entry signal causing the note selection code present on said code lines to be stored in the data storage section of the data register of said next available output channel, and means for enabling generation of musical tones corresponding to notes identified by codes stored in said output channels.

* * * * *